US005177932A

United States Patent [19]

Schmetzer

[11] Patent Number: 5,177,932

[45] Date of Patent: Jan. 12, 1993

[54] APPARATUS FOR PRODUCING A PACKING

[75] Inventor: Helmut Schmetzer, Almstrasse 5, D-858o, Fed. Rep. of Germany Helmut Schmetzer, Almstrasse 5, D-858o, Rep. of Germany

[73] Assignees: Horst Schwede; Roland Schwede; Helmut Schmetzer, all of Fed. Rep. of Germany

[21] Appl. No.: 749,536

[22] Filed: Aug. 23, 1991

Related U.S. Application Data

[63] Continuation-in-part of Ser. No. 557,712, Jul. 25, 1990, abandoned.

[51] Int. Cl.[5] ..... B65B 11/10; B65B 51/00; B65B 61/06

[52] U.S. Cl. ..... 53/228; 53/550; 53/552; 53/138.1; 53/373.2; 53/374.8; 29/432.2; 29/521; 493/350; 493/390

[58] Field of Search ..... 53/228, 229, 427, 412, 53/374.8, 373.2, 486, 487, 374.2, 466, 138.1, 550, 552; 29/432.2, 521; 493/350, 390, 391, 392

[56] References Cited

U.S. PATENT DOCUMENTS

| | | | |
|---|---|---|---|
| 2,188,222 | 1/1940 | Hibbs | 493/390 |
| 2,272,473 | 2/1942 | Noll | 493/390 |
| 2,372,406 | 3/1945 | Treneer | 53/427 X |
| 3,106,139 | 10/1963 | Leopoldi | 493/390 |
| 3,158,973 | 12/1964 | Monaghan | 53/229 X |
| 3,323,983 | 6/1967 | Palmer et al. | 493/390 |
| 3,589,100 | 6/1971 | Konars et al. | 53/229 |
| 3,728,779 | 4/1973 | Behlen et al. | 29/521 X |
| 3,874,976 | 4/1975 | MacFarland, Jr. | 53/229 X |
| 3,890,761 | 6/1975 | Ramsey | 53/427 |
| 3,981,064 | 9/1976 | Hafner | 29/521 X |
| 4,499,706 | 2/1985 | Scheller | 53/466 |
| 4,509,314 | 4/1985 | Bozza | 53/228 |
| 4,534,092 | 8/1985 | Tracy | 29/521 X |
| 4,835,850 | 6/1989 | Eckold et al. | 29/521 X |
| 5,010,714 | 4/1991 | Medwed et al. | 53/412 |

FOREIGN PATENT DOCUMENTS

| | | |
|---|---|---|
| 1452627 | 10/1969 | Fed. Rep. of Germany . |
| 1965648 | 9/1970 | Fed. Rep. of Germany . |
| 2156134 | 5/1972 | Fed. Rep. of Germany . |
| 3515643 | 10/1986 | Fed. Rep. of Germany . |
| 508906 | 7/1939 | United Kingdom . |
| 8806016 | 7/1988 | World Int. Prop. O. . |

*Primary Examiner*—Horace M. Culver
*Attorney, Agent, or Firm*—Laff, Whitesel, Conte & Saret

[57] ABSTRACT

In order to connect at least two layers of paper or the like, the layers are cut into strips in the connection area and forced out of the plane of the layers alternately and in pairs. To this effect punching and pressing tools with punching teeth may be provided.

21 Claims, 10 Drawing Sheets

APPARATUS FOR PRODUCING A PACKING

This is continuation-in-part of our application No. 07/557,712 filed Jul. 25, 1990 and now abandoned.

FIELD OF THE INVENTION

The invention relates to an apparatus for producing a packing by connecting at least two layers of paper, thin board, in particular craft paper and recycling paper, in an adhesive-free manner, the layers being put together along a connection seam and being connected with each other by a punching and pressing action by alternating deformation approximately across the plane of the layers.

BACKGROUND OF THE INVENTION

It is known to connect paper, thin board or the like in an adhesive-free manner in such a way that two layers of paper or the like arranged on top of each other are deformed by means of a knurling roller out of the main plane of the layers. Thus, a certain denticulation of the two layers consisting of web sections or sheets is achieved. This kind of connection is not particularly firm. For this reason an adhesive is very often used in this context.

Lots of things are wrapped up in plastic sheets, which are glued or welded to one another or which are shrunk on. The use of plastic sheets is not desirable. Moreover, vapours result during the shrinking of sheets, which are not desirable, either. The wrapping up with paper necessitates the use of an adhesive, which on the one hand is not desirable for reasons of pollution control. Moreover, it takes a considerable time as a rule for the adhesive to cure or dry to such extent that the connecting seam is sufficiently firm. On the other hand, there are many fields of application where the demands on a firm packing or wrapping or the demands on a firm connection are not very high, since the packing or wrapping is provided for a short period of time as a rule for transport only.

SUMMARY OF THE INVENTION

It is accordingly the object of the invention to embody an apparatus for the production of a packing, by means of which a particularly non-polluting packing can be realized in simple manner.

This object is attained in accordance with an apparatus of the above type comprising at least a pair of a first and a second punching and pressing tool, which first and second punching and pressing tools are complementarily associated with each other and are alternately provided with punching teeth, with in each case one punching tooth of the first punching and pressing tool being provided to engage with an interspace between two neighbouring punching teeth of the second punching and pressing tool, with a width of each interspace essentially corresponding to a width of a corresponding punching tooth and with an edge limiting each punching tooth towards a neighbouring interspace being provided as a cutting edge, wherein the punching teeth of each first and second punching and pressing tool are lined up in a common tool plane, and a pair of a first and a second tool carrier, wherein the first punching and pressing tool is arranged on the first tool carrier and wherein the second punching and pressing tool is arranged on the second tool carrier, and wherein at least one of the tool carriers is movable in a direction perpendicular to said tool plane. By means of the punching and pressing tools the layers are put together in a connection area and are connected with each other across a main plane of the layers, wherein said layers are cut in strips only in the connection area, which strips each have two ends, both ends remaining uncut and connected to one of said layers and cut edges between said ends, and which strips are forced out of said main plane of the layers alternately in pairs and which cut edges are distorted in an arch-like manner. As a result of the measures according to the invention it is achieved that the strips, which remain of course connected with their ends to the corresponding layer of paper or the like, are forced out of the layers alternately and oppositely in pairs, thus hooking the two layers in an extraordinarily intensive manner. The less smooth, i.e. the simpler, the paper, the thin board or the like are, the firmer is the connection. Thus, craft paper and recycling paper are particularly apt. The packing or wrapping may for example serve to wrap up stacks of newspapers or journals for shipment, with only four sides being wrapped up, whilst two opposite sides remain uncovered. For the purpose of safe transporting of these packages they may in addition be surrounded by one hoop or several hoops. Furthermore, other things, such as clothes or single or several journals may be wrapped up in a bag-like packing closed on some sides with an apparatus according to the invention.

Further advantages, features and details of the invention will become apparent from the ensuing description of two exemplary embodiments, taken in conjunction with the drawings.

DESCRIPTION OF THE PREFERRED EMBODIMENTS

Figure 1:
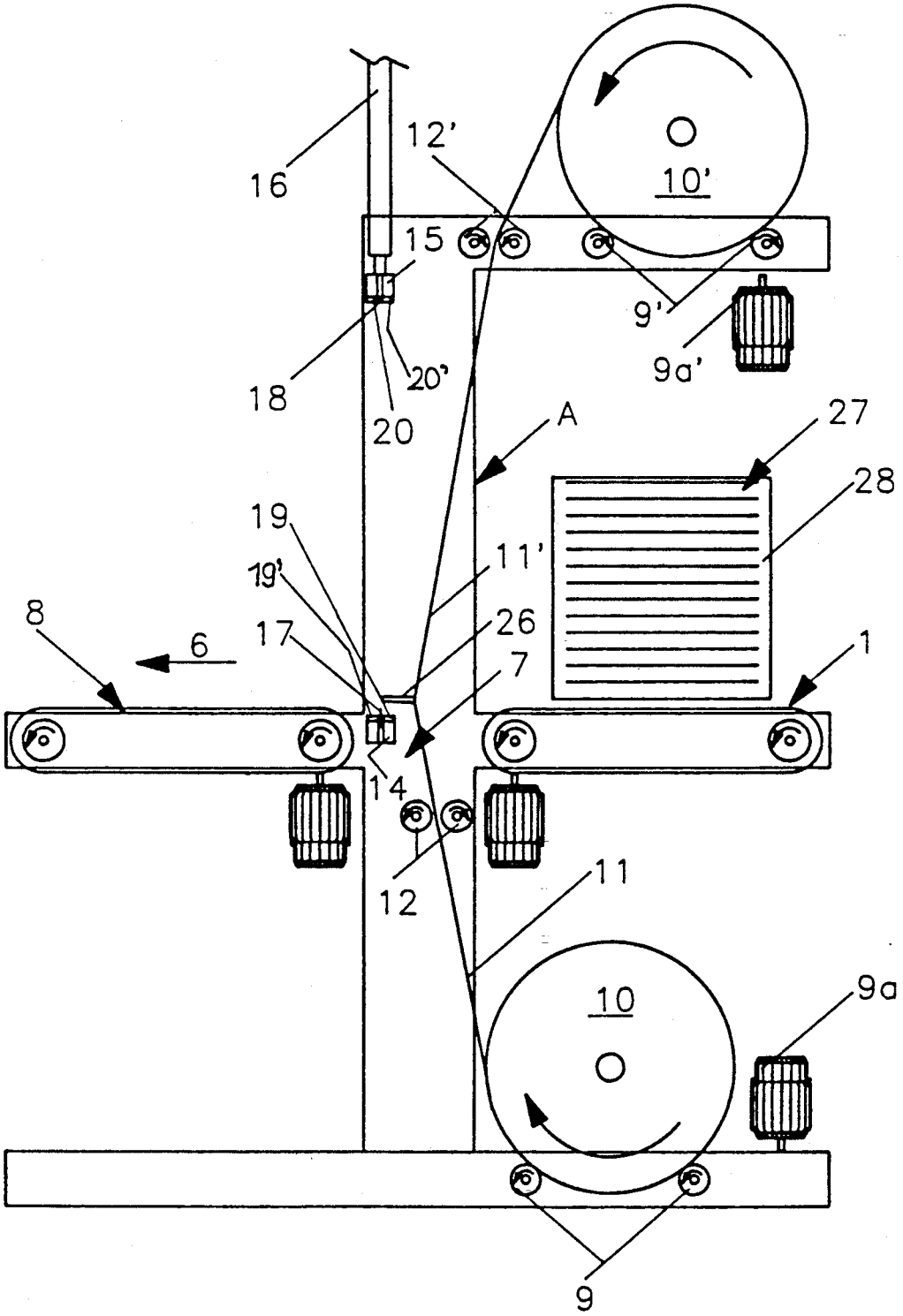
FIG. 1 shows an apparatus for the wrapping up of things in a diagrammatic representation, with an object entering.

Referring to the embodiment according to FIGS. 1 to 5, a feeding conveying belt 1 is located about in the center of a machine frame A and comprises an endless belt 2, a deflection pulley 3 and a driven transport pulley 4, via which it is guided. The drive is generated by an electric motor 4*a*. The top run 5 of the belt 2 is drivable in transport direction 6, i.e. from the right to the left in the drawing. A working station 7 to be described below is provided to follow in transport direction, which is followed by a discharge conveying belt 8 designed in the same way as the conveying belt 1. Its components therefore have the same reference numerals with a prime. The top run 5 and the top run 5' are in alignment. A roll 10 of web-shaped packing or wrapping material, such as paper, craft paper, recycling paper or the like, is arranged below the feeding conveying belt 1 on idler pulleys 9, one of which is drivable by means of an electric motor 9*a*. A web 11 is drawn off the roll 10 by means of a pair of drawing-off pulleys 12 and fed to the working station 7. The pair of drawing-off pulleys 12 is equally drivable by a motor which is however not shown. A further roll 10' of the same packing or wrapping material as that of the roll 10 is supported on idler pulleys 9' above the feeding conveying belt 1. A web 11' is drawn off this roll 10' via a pair of drawing-off pulleys 12' and fed to the working station 7.

A connecting device 13 is provided in the working station 7, by means of which the two webs 11 and 11' are connected with each other in an adhesive-free manner. This connecting device 13 has a lower beam 14 and an upper beam 15 serving as a tool carrier. In the embodiment shown the lower beam 14 is stationary; it may, however, also be drivable vertically by means of one or several linear drives, for example piston-cylinder drives. The upper beam 15 is vertically slidable by means of at least one linear drive 16 in the form of a hydraulically or pneumatically actuatable piston-cylinder drive. It is in its upper rest position in FIGS. 1 and 2.

The lower beam 14 has a cutting knife 17 arranged centrally and extending at least over the width of the webs 11, 11' which cutting knife 17 immerges into an opposite slot 18 in the upper beam 15 when the beams 14, 15 are joined.

Figure 5:
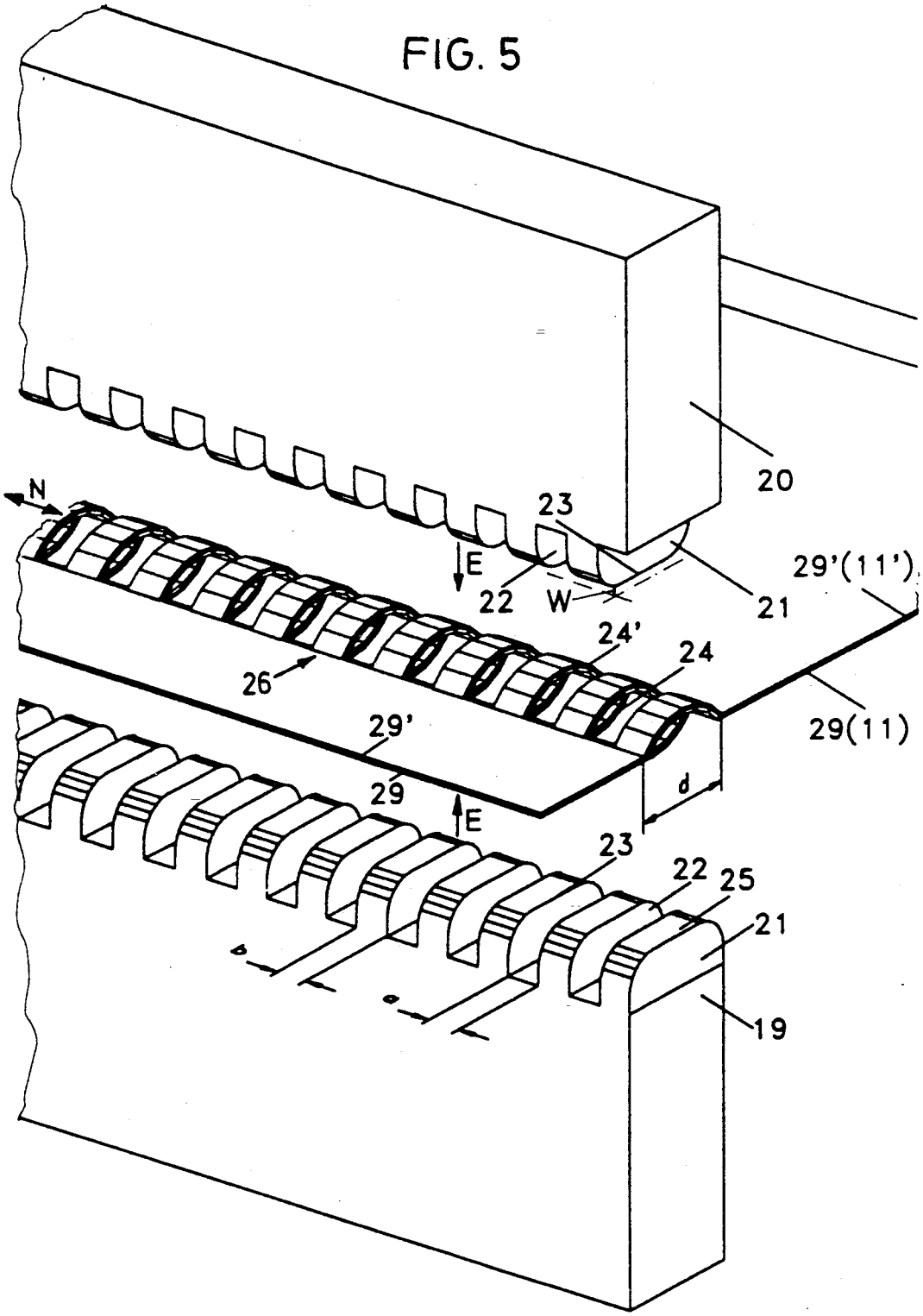
FIG. 5 shows two layers of paper with two punching and pressing tools after a connecting seam has been produced.

A pair of punching and pressing tools 19, 19' and 20, 20', respectively, is arranged on each side of the cutting knife 17 and the opposite slot 18, respectively, which punching and pressing tools 19, 20 are associated in pairs and shown in greater detail in FIG. 5. Each tool 19, 20 has identical punching teeth 21, the distance a between them being larger than their width b only by some hundredths of a millimeter, so that the tools 19, 19', 20, 20' offset may engage with one another, whereby the punching teeth 21 of one tool 19 immerge in between the neighbouring punching teeth 21 and vice versa. The edges limiting the punching teeth 21 towards each interspace 22 form cutting edges 23. The punching teeth 21 of each punching and pressing tool 19, 19', 20, 20' are in each case lined up in a common tool plane W. The tool planes W of the tools 19, 19', 20, 20' are horizontal, the beams 14, 15 thus being drivable towards each another and away from each other perpendicularly to the tool planes W by means of the linear drive.

When-as can in particular be seen from FIG. 5-two webs 11, 11' lying flat one upon the other in this area are guided between two tools 19, 20, then both webs are punched at the cutting edges 23 associated in pairs of the punching teeth 21 of both tools, whereby both webs 11, 11' are cut into strips 24, 24' extending in transport direction 6 and transverse to the seam direction N in this area and corresponding in their width e to the width b of the punching teeth 21. These strips 24, 24' are bent out of the common plane of the webs 11, 11' in each case in pairs and alternately corresponding to the extension of the surface 25 of the punching teeth 21 limited by the cutting edges 23. An extraordinarily firm connecting seam 26 is thus achieved. Regarding the length d of the strips 24, 24' in relation to their width e $7e \geqq d \geqq 2e$ applies.

As mentioned, a pair of such punching and pressing tools 19, 19', 20, 20' is provided on each of the beams 14, 15 on both sides of the cutting knife and the opposite slot 18, respectively, so that upon closing of the connecting device 13 by joining the beams 14, 15, the two webs 11, 11' are connected with each other by means of two connecting seams 26, while at the same time the two webs 11, 11' are cut through between the two seams 26.

Figure 2:
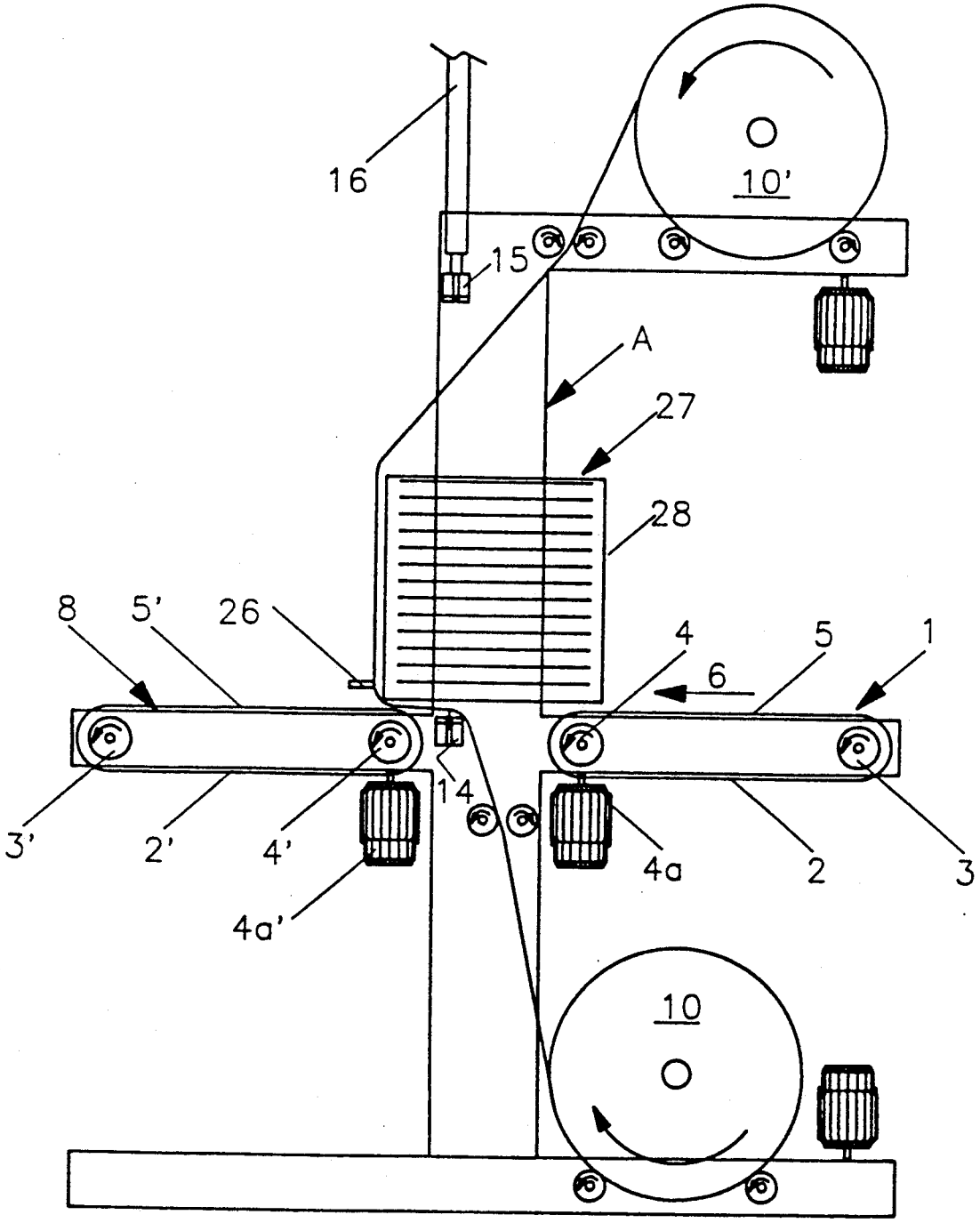
FIG. 2 shows an apparatus according to FIG. 1, with the object arriving at a working station.

FIG. 1 shows the starting position, in which the two webs 11, 11' are connected with each other by means of a seam 26. The upper beam 15 is lifted so that an object 27 to be packed or wrapped up, for example a stack of newspapers or journals, may be fed in transport direction 6 via the feeding conveying belt 1. As represented in FIG. 2 it crosses the working station 7 and arrives on the discharge conveying belt 8 taking along the two webs 11, 11'. The cutting knife 17 is located at least slightly below the plane spread out by the two top runs 5, 5', in order that the working station 7 may be crossed freely.

Figure 3:
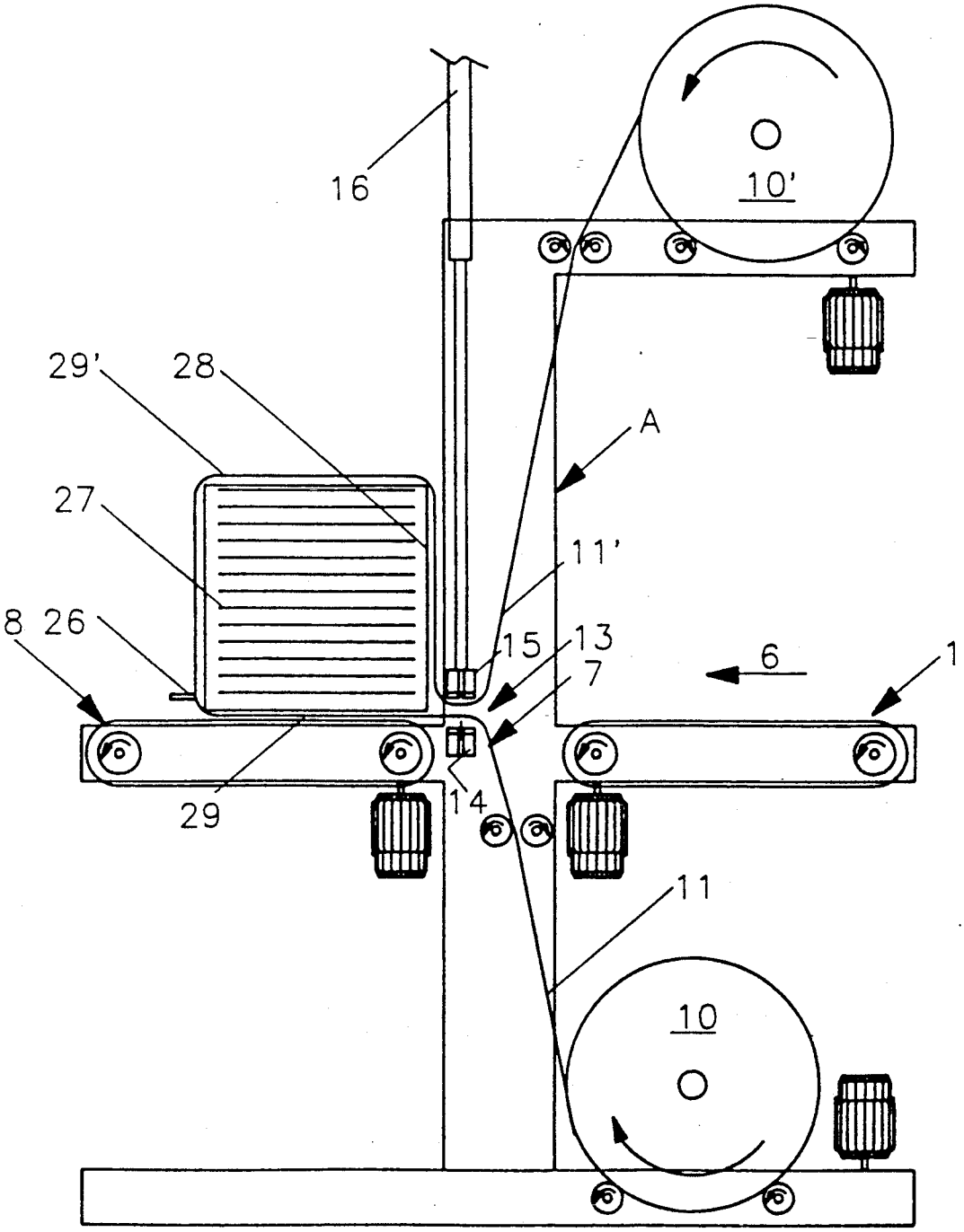
FIG. 3 shows the apparatus according to FIGS. 1 and 2, with a connecting seam being produced.

When the object 27 is in the working position shown in FIG. 3 on the conveying belt 8, in which its back 28-related to the direction of transport 6—is already on the other side of the beams 14, 15, then the connecting device 13 is closed. To this effect the upper beam 15 drives downwards taking along the upper web 11'. When the two beams 14, 15 are joined, two connecting seams 26 are formed between the two webs 11, 11' which are at the same time cut through between these seams 26. The object 27 now wrapped up by web sections 29, 29' is discharged via the conveying belt 8, while at the same time a new object is fed via the feeding conveying belt 1.

Figure 4:
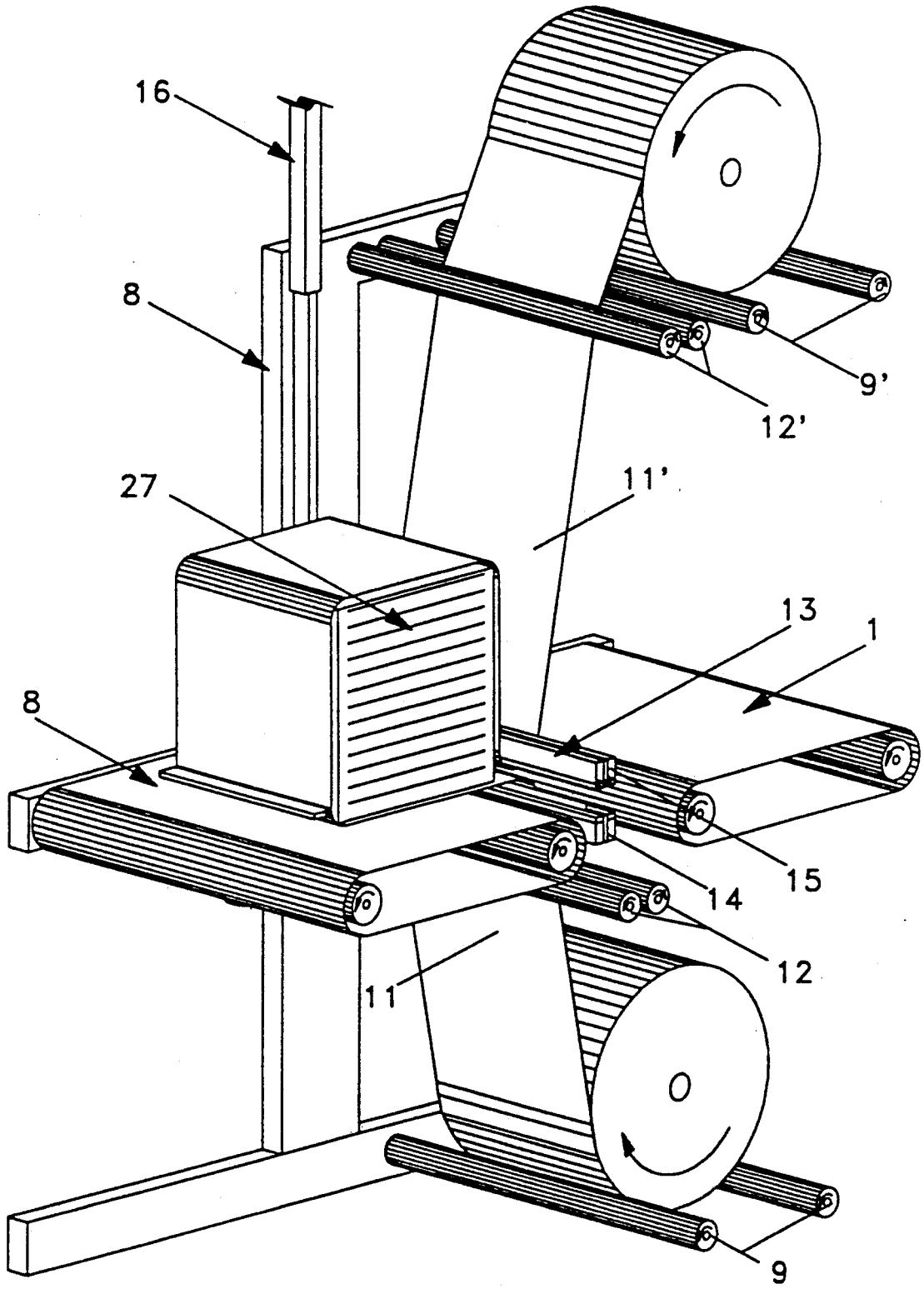
FIG. 4 shows the apparatus according to FIGS. 1 to 3 in a perspective view.

In the diagrammatic representation of FIG. 4 the side of the machine frame A facing the viewer has been omitted for reasons of clearness.

It must further be added that all drives, i.e. in particular the electric motors 4*a*, 4*a'*, 9*a*, 9*a'* of the transport pulleys 4, 4' and of the idler pulleys 9, 9' and the drives of the pairs of drawing-off pulleys 12, 12' and the linear drive or the linear drives 16, are triggered by an overall control so that the described cycles are attained. This is realized with known and commercially available control devices.

As a result of the punching of the strips 24, 24' and of their being guided along the sides of the punching teeth 21 or 38, respectively, the edges of the strips 24, 24' are squeezed or distorted and are thus even better connected.

Figure 6:
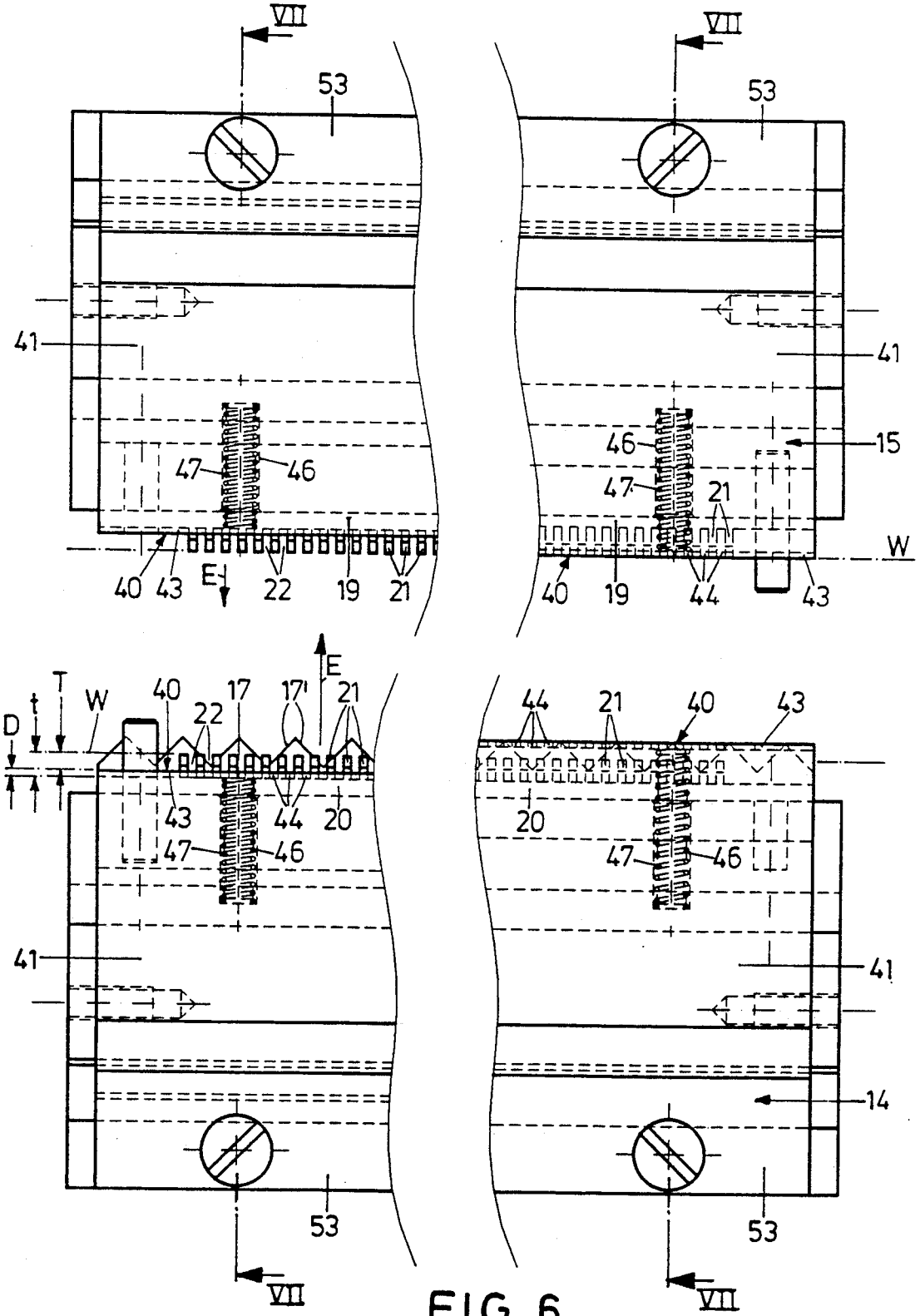
FIG. 6 is a lateral view of two complementary punching and pressing tools each provided with deflectors.
Figure 7:
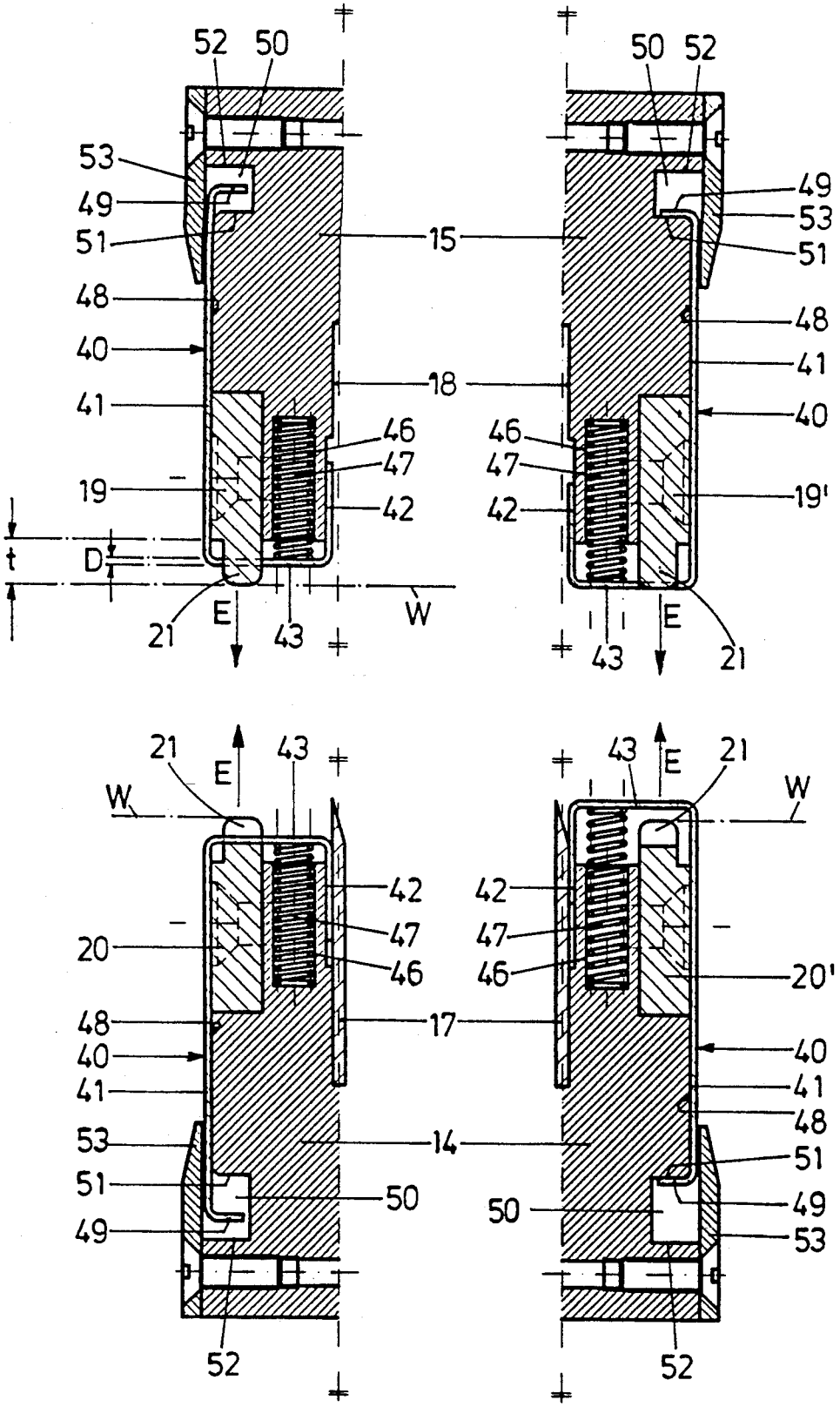
FIG. 7 shows partial cross-sections of complementary punching and pressing tools along the section line VII—VII according to FIG. 6 with different deflector positions.

In FIGS. 6 and 7 two beams 14, 15 with pairs of complementary punching and pressing tools 19, 19', 20, 20' are illustrated in detail as they can be used in an apparatus according to FIGS. 1 to 4. In accordance with the above description a lower beam 14 and upper beam 15 is shown in these Figures. In FIG. 7 each of the beams 14, 15 is shown in part as far as their central longitudinal plane, the lower beam 14 in FIG. 7 comprising the only available cutting knife 17 in both partial representations. In the case of the upper beam the partial representation ends on the level of the opposite slot 18.

Figure 12:
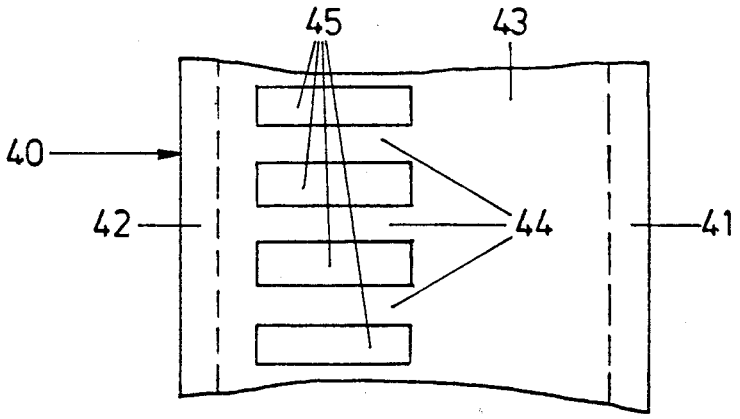
FIG. 12 is a plan view of a deflector according to FIGS. 6 and 7.

Each beam 14, 15 has two punching and pressing tools 19, 19' and 20, 20', respectively, as they have been shown in detail in FIG. 5. In addition, deflectors 40 associated with the respective punching and pressing tool 19, 19', 20, 20' are provided on each beam 14, 15, which deflectors 40 are in the form of an oblong profile substantially U-shaped in cross-section. The deflectors' external U-legs 41 flank the longitudinal sides 48 of the beams 14, 15 extending in parallel to the direction of engagement E of the punching teeth 21. The internal U-legs 42 are arranged in the opposite slot 18 of the beam 15 and in a slot 18' between the cutting knife 17 and the beam 14, respectively. The U-base 43 of the deflectors 40 extends in the vicinity of the punching teeth 21, the deflection webs 44 being formed between rectangular recesses 45 in the U-base 43 (FIG. 12). The punching teeth 21 pass through these recesses 45. The deflection webs 44 thus engage with each interspace 22 between two neighbouring punching teeth 21.

By the two U-legs 41, 42 being guided along the longitudinal sides 48 of the beams 14, 15 and the opposite slot 18, respectively, and the slot 18', respectively, each deflector 40 is displaceably supported in a manner loaded by a compression spring 47 clamped between its U-base 43 and a blind hole bore 46, which related to the longitudinal direction of the punching and pressing tools 19, 19', 20, 20' is adjacent to the latter, against the direction of engagement E of the respective punching teeth 21 of the complementary punching and pressing tools 20, 20', 19, 19'.

The deflectors 40 are further supported for displacement between an extracted and retracted stop position. The extracted stop position, as it is taken when the punching and pressing tools 19, 20 and 19', 20', respectively, are apart, is shown in the parts on the right of FIGS. 6 and 7, respectively. In the parts on the left of FIG. 7 the deflectors 40 are shown in a mid-position. In the case of the retracted stop position according to the parts on the left of FIG. 6 the deflectors 40 abut with their deflection webs 44 on the bottom of the interspaces 22, which is achieved by the depth of the engagement T of each punching tooth 21 on the one punching and pressing tool 19 and 19', respectively, with the corresponding interspace of the complementary punching and pressing tool 20 and 20', respectively, corresponding to the depth t of the interspace 22 less the thickness D of the deflection webs 44. To ensure such a depth of engagement T, it is sufficient for the two beams 14, 14' to be moved into engagement position, the engagement movement being defined by the mutual abutment of the complementary punching and pressing tools 19, 20 and 19', 20', respectively. The two layers of paper strips 24, 24' are thus additionally squeezed together, to that the stability of the connecting seam is further increased by the punching process. For the purpose of the close connection between the strips 24, 24' not being weakened when the strips are removed from the interspaces 22, the deflectors 40 are provided with their deflection webs 44. The latter additionally serve to remove torn off paper scraps and other foreign matter from the interspaces 22.

As further seen in FIGS. 6 and 7, the U-base 43 of the deflectors 40 in their extracted position (parts on the right in FIGS. 6 and 7) is arranged in the direction of engagement E ahead of the punching teeth 21 and in the case of the lower beam 14 also ahead of the cutting knife 17, so that the cutting edges 23 of the punching teeth 21 and the zigzag blades 17' of the cutting knife 17 are covered in this position. It is thus avoided that an operator is injured when servicing the packing apparatus.

As shown in FIG. 7, the travel of the deflectors 40 in their extracted or retracted stop position is defined in that the external U-leg 41 is extended and bent over at its end. This bead 49 runs in an outside groove 50 on the beams 14, 15. The travel of the deflectors 40 is defined by their abutting on the upper and lower groove side wall 51, 52. The engagement of the bead 49 with the groove 50 is maintained by the strip-shaped cover 53.

Figure 8:
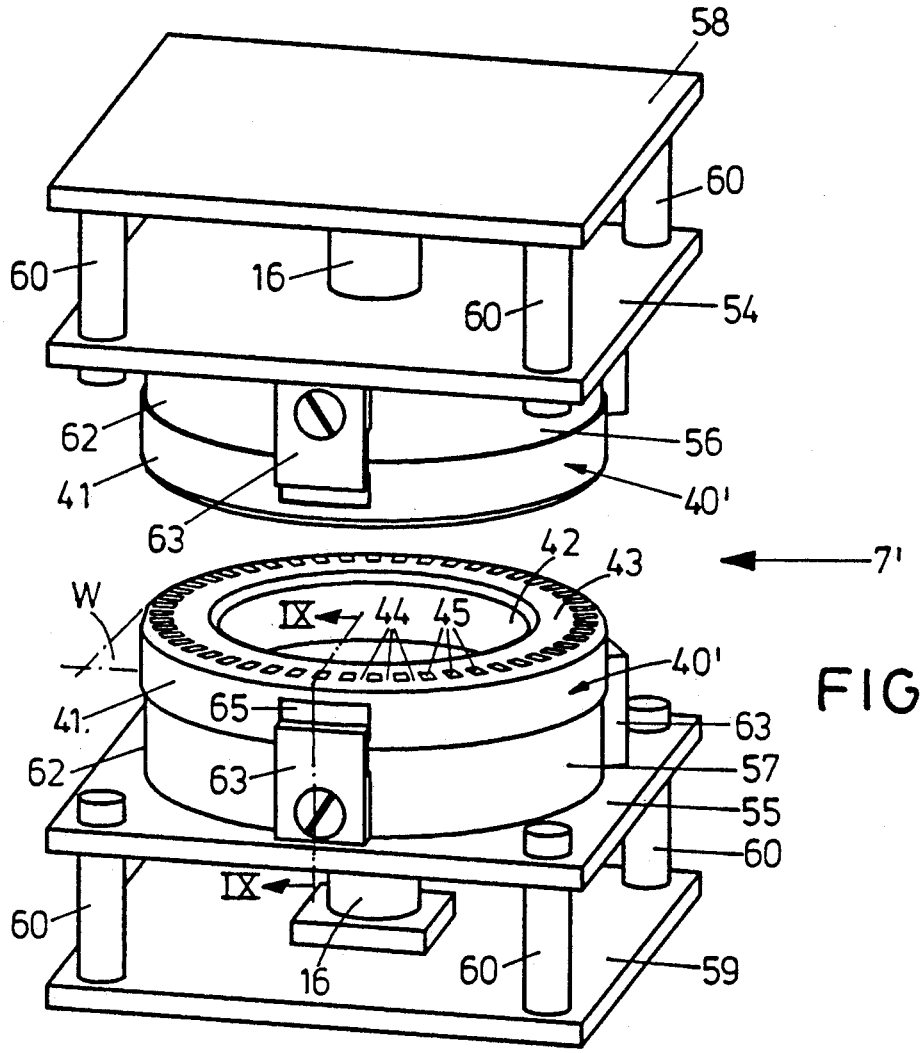
FIG. 8 is a perspective representation of a working station of a packing apparatus with in each case associated punching and pressing tools mutually complementary for the production of a closed connecting seam.

FIG. 8 shows plate-shaped tool carriers 54, 55, on which complementary punching and pressing tools 56, 57 are held. Further, two plates 58, 59 and guide braces 60 are to be seen in shortened representation in the diagrammatic FIG. 8, the plates 58, 59 forming part of the machine frame A. A linear drive 16 only diagrammatically outlined for instance in the form of a piston-cylinder drive is illustrated between these plates 58, 59 and the tool carriers 54, 55. The group of parts shown in FIG. 8 essentially forms a working station 7' analogous with the working station 7 according to FIGS. 1 to 4.

Figure 9:
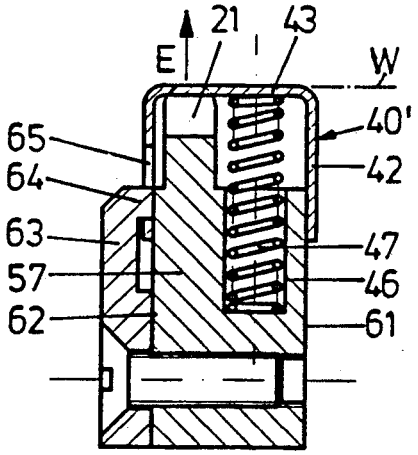
FIGS. 9 and 10 are sections through the punching and pressing tool along the section plane IX—IX according to FIG. 8 in different deflector positions.
Figure 10:
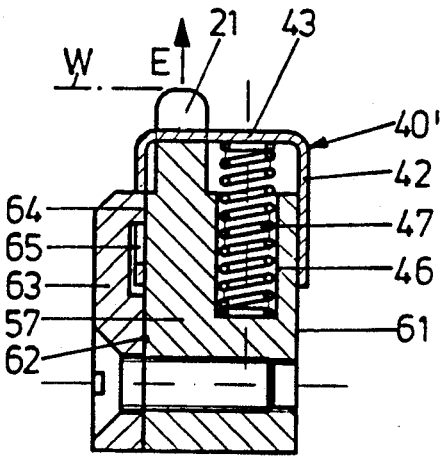

As distinguished from the apparatus shown in FIGS. 1 to 4, the punching teeth 21 of the punching and pressing tools 56, 57 of the working station 7' according to FIGS. 8 to 10 are in each case lined up to form a circumferential, closed, annular connecting seam on a circle forming the tool plane W. Again deflectors 40' are provided, which are U-shaped in cross-section and provided with deflection webs 44' engaging with the interspaces 22 between the punching teeth 21, but which form a closed circular ring in their longitudinal extension. Analogous with the deflectors 40 of FIGS. 6 and 7 the deflectors 40' are supported on the punching and pressing tools 56, 57 for displacement between an extracted stop position (FIG. 9) and a retracted stop position, with the U-legs 41, 42 being guided along the inside 61 and the outside 62, respectively, of the annular punching and pressing tools 56, 57. The stop positions of the deflectors 40' are realized by claws 63 screwed on to the outside 62 of the punching and pressing tools 56, 57 and of which the ends 64 engage with a corresponding recess 65 in the external U-legs 42 of the deflectors 40.

Figure 11:
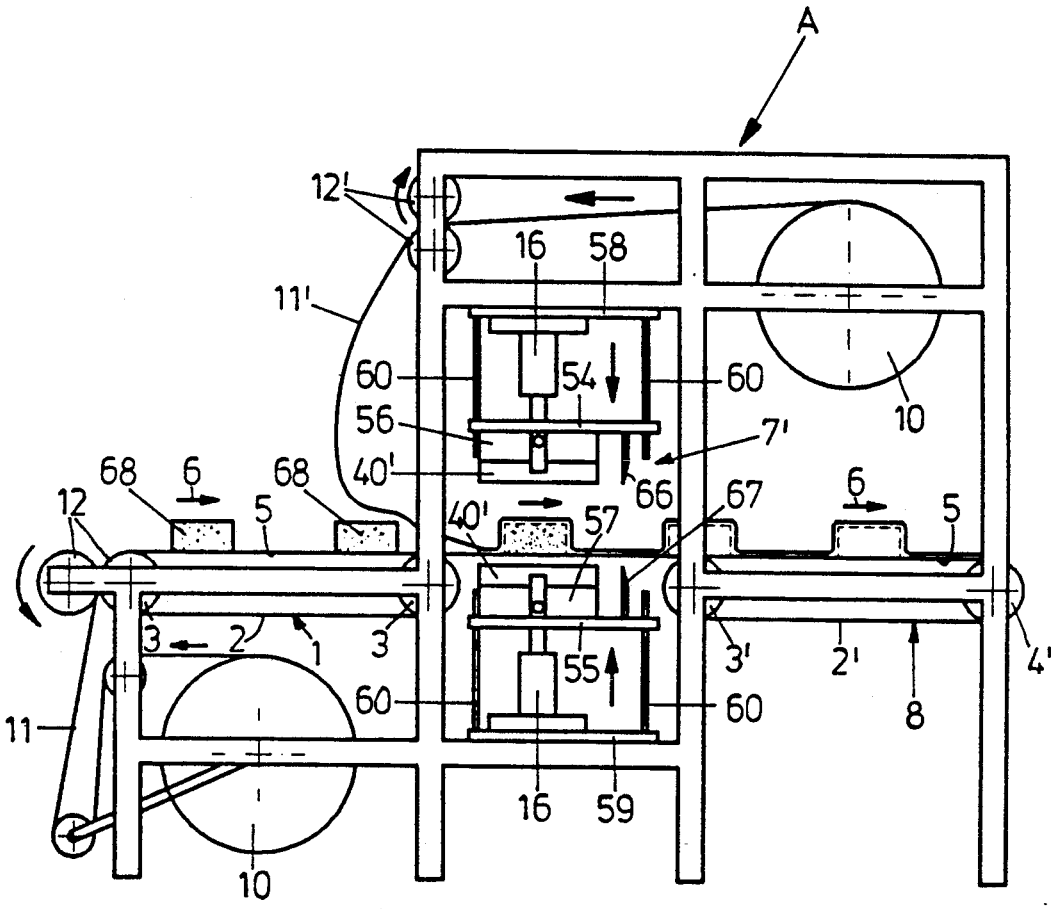
FIG. 11 is a diagrammatic representation of a second embodiment of an apparatus for the packing of objects with a working station according to FIG. 8.

FIG. 11 is a diagrammatic representation of an alternative packing apparatus in its entirety, the punching and pressing tools 56, 57 shown in FIGS. 8 to 10 being utilized in the working station 7'. It must be added that perforating knives 66, 67 are provided on the two plate-shaped tool carriers 54, 55 outside the punching and pressing tools 56, 57 and perforate the two webs 11, 11' between two adjacent annular connecting seams. This takes place together with the punching action of the two punching and pressing tools 56, 57 for the production of the annular connecting seam in the working station 7'.

The packing apparatus illustrated in FIG. 11 serves to wrap up small pieces, such as ball bearings 68, which are enclosed between two webs 11, 11' surrounded by an annular connecting seam. Since the structure essentailly corresponds to the apparatus according to FIGS. 1 to 4, reference is made to the corresponding description to avoid repetition, with analogous components having identical reference numerals.

What is claimed is:

1. In an apparatus for producing a packing made of at least two layers of packing paper, in particular craft paper, recycling paper and thin board, which layers cover an object to be packed and are put together along a connecting seam (26) in an adhesive-free manner by a punching and pressing action, the improvement comprising:

at least a pair of a first and a second punching and pressing tool (19, 20; 19', 20'; 56, 57), which first and second punching and pressing tools (19, 19', 20, 20', 56, 57) are complementary associated with each other;

punching teeth (21) alternately provided at said first and second punching and pressing tools (19, 20; 19', 20'; 56, 57), which punching teeth (21) of each first and second punching and pressing tool (19, 19', 20, 20', 56, 57) are lined up in a common tool plane (W);

an interspace (22) between each of said punching teeth (21) with in each case one punching tooth (21) of the first punching and pressing tool (19 and 20, 19' and 20', 56 and 57), being provided to engage with an interspace (22) between two neighbouring punching teeth (21, 38) of the second punching and pressing tool (20 and 19, 20' and 19', 57 and 56), with a width (a) of each interspace (22) essentially corresponding to a width (b) of a corresponding punching tooth (21);

an edge limiting each punching tooth (21; 38) towards a neighbouring interspace (22) being provided as a cutting edge (23);

a first and a second tool carrier (14, 15; 54, 55), wherein the first punching and pressing tool (19, 19', 56) is arranged on the first tool carrier (15, 55) and wherein the second punching and pressing tool (20, 20', 57) is arranged on the second tool carrier (14, 54), and wherein at least one of the tool carriers (14, 15, 54, 55) is movable in a direction perpendicular to said tool plane (W).

2. An apparatus according to claim 1, wherein the first and the second punching and pressing tool (19, 19', 20, 20') each has punching teeth (21) lined up in a straight line and is in the form of a beam.

3. An apparatus according to claim 2, wherein the first and second punching and pressing tools (19, 19' and 20, 20'), are arranged on each first and second tool carrier (14 and 15).

4. An apparatus according to claim 3, wherein a cutting knife (17) is arranged on at least one of said each first and second tool carriers (14) between said two punching and pressing tools (19) arranged on one of said each tool carriers (14).

5. An apparatus according to claim 1, wherein the punching teeth (21) of each of said first and second punching and pressing tools (56, 57) are lined up in a circumferential, closed line.

6. An apparatus according to claim 5, wherein said punching teeth (21) are lined up in a circle.

7. An apparatus according to claim 5, wherein, outside said first and second punching and pressing tools (56, 57) provided with punching teeth (21) lined up on a circumferential closed line, a perforating knife (66, 67) is provided on the first and second tool carrier (54, 55).

8. In an apparatus for producing a packing made of at least two layers of packing paper, in particular craft paper, recycling paper and thin board, which layers cover an object to be packed and are put together along a connecting seam (26) in an adhesive-free manner by a punching and pressing action, the improvement comprising at least a pair of a first and a second punching and pressing tool (19, 20; 19', 20'; 56, 57), which first and second punching and pressing tools (19, 19', 20, 20', 56, 57) are complementarily associated with each other;

punching teeth (21) alternately provided at said first and second punching and pressing tools (19, 20; 19', 20'; 56, 57), which punching teeth (21) of each first and second punching and pressing tool (19, 19', 20, 20', 56, 57) are lined up in a common tool plane (W);

an interspace (22) between' each of said punching teeth (21) with in each case one punching tooth (21) of the first punching and pressing tool (19 and 20, 19' and 20', 56 and 57, ) being provided to engage with an interspace (22) between two neighbouring punching teeth (21, 38) of the second punching and pressing tool (20 and 19, 20' and 19', 57 and 56, ), with a width (a) of each interspace (22) essentially corresponding to a width (b) of a corresponding punching tooth (21);

an edge limiting each punching tooth (21; 38) towards a neighbouring interspace (22) being provided as a cutting edge (23);

a first and a second tool carrier (14, 15; 54, 55), wherein the first punching and pressing tool (19, 19', 56) is arranged on the first tool carrier (15, 55) and wherein the second punching and pressing tool (20, 20', 57) is arranged on the second tool carrier (14, 54), and wherein at least one of the tool carriers (14, 15, 54, 55) is movable in a direction perpendicular to said tool plane (W);

deflectors (40) for each of said first and second punching and pressing tools (19, 20; 19', 20'; 56, 57), each of which is supported to be displaceable against a force of a compression spring (47), which is directed against the direction of engagement (E) of the punching tooth (21) of the first punching and pressing tool (19, 19', 56) with the interspace (22) of the second punching and pressing tool (20, 20', 57) and vice versa; and deflection webs (44) provided at each of said deflectors (40), each of said webs (44) engaging with the interspace (22) between two adjacent punching teeth (21).

9. An apparatus according to claim 8, wherein each of the deflectors (40) is attached to each of said first and second tool carriers (14, 15).

10. An apparatus according to claim 8, wherein each deflector (40) is substantially U-shaped in cross-section, U-legs (41, 42) of said deflector (40) flanking longitudinal sides (48) of the tool carrier (14, 15) extending in parallel to the direction of engagement (E), and a U-base (43) of said deflector (40) extending in the vicinity of the punching teeth (21), the deflection webs (44) being formed between recesses (45) in the U-base (43), through which the punching teeth (21) pass.

11. An apparatus according to claim 8, wherein each deflector (40) is substantially U-shaped in cross-section, U-legs (41, 42) of said deflector (40) flanking longitudinal sides (48) of the tool (56, 57) extending in parallel to the direction of engagement (E), and a U-base (43) of said deflector (40) extending in the vicinity of the punching teeth (21), the deflection webs (44) being formed between recesses (45) in the U-base (43), through which the punching teeth (21) pass.

12. An apparatus according to claim 8, wherein the deflector (40) is slidably supported between an extracted and a retracted stop position while being arranged in the extracted stop position when said first and second punching and pressing tools (19, 20 and 19', 20', and 56, 57, are apart and in the retracted stop position when said first and second punching and pressing tools (19, 20 and 19', 20', and 56, 57, ) are in engagement.

13. An apparatus according to claim 12, wherein, in the extracted stop position, the U-base (43) of each deflector (40) is arranged ahead of the punching teeth (21) of the associated first and second punching and pressing tool (19, 19', 20, 20', 56, 57) in the direction of engagement (E).

14. An apparatus according to claim 8, wherein the depth of engagement (T) of each punching tooth (21) of said first punching and pressing tool (19, 19', 20, 20', 56, 57) with the corresponding interspace (22) of said second punching and pressing tool (20, 20', 19, 19', 57, 56) corresponds to the depth (t) of the interspace (22) less the thickness (D) of the deflection webs (44).

15. An apparatus according to claim 12, wherein, in the extracted stop position, said U-base (43) of each deflector (40) is arranged ahead of the cutting knife (17) in the direction of engagement (E).

16. An apparatus according to claim 8, wherein the first and the second punching and pressing tool (19, 19', 20, 20') each has punching teeth (21) lined up in a straight line and is in the form of a beam.

17. An apparatus according to claim 16, wherein two first and second punching and pressing tools (19, 19' and 20, 20', ) are arranged on each first and second tool carrier (14 and 15, ).

18. An apparatus according to claim 17, wherein a cutting knife (17) is arranged on at least one of said each first and second tool carriers (14) between said two punching and pressing tools (19) arranged on one of said each tool carriers (14).

19. An apparatus according to claim 18, wherein the punching teeth (21) of each of said first and second punching and pressing tools (56, 57) are lined up in a circumferential, closed line.

20. An apparatus according to claim 19, wherein said punching teeth (21) are lined up in a circle.

21. An apparatus according to claim 19, wherein, outside said first and second punching and pressing tools (56, 57) provided with punching teeth (21) lined up on a circumferential closed line, a perforating knife (66, 67) is provided on the first and second tool carrier (54, 55).

* * * * *